United States Patent [19]

Furukawa et al.

[11] Patent Number: 4,697,532

[45] Date of Patent: Oct. 6, 1987

[54] OPERATING METHOD FOR A REFUSE PROCESSING FURNACE

[75] Inventors: Toshiharu Furukawa; Susumu Shimura, both of Nagoya; Fumio Takai, Seki; Norio Sano; Tomonobu Ishida, both of Ichinomiya, all of Japan

[73] Assignee: Daido Tokushuko Kabushikikaisha, Nagoya, Japan

[21] Appl. No.: 900,894

[22] Filed: Aug. 27, 1986

[30] Foreign Application Priority Data

| | | | |
|---|---|---|---|
| Aug. 27, 1985 | [JP] | Japan | 60-187798 |
| Nov. 11, 1985 | [JP] | Japan | 60-254484 |
| Dec. 16, 1985 | [JP] | Japan | 60-282604 |
| Apr. 7, 1986 | [JP] | Japan | 61-79400 |

[51] Int. Cl.[4] ..... F23G 5/00

[52] U.S. Cl. ..... 110/346; 110/101 CD; 110/250

[58] Field of Search ..... 110/250, 101 CD, 346; 373/49

[56] References Cited

U.S. PATENT DOCUMENTS

| | | | |
|---|---|---|---|
| 3,822,657 | 7/1974 | Midkiff | 110/101 CD |
| 4,513,671 | 4/1985 | Eshleman | 110/101 CD X |

FOREIGN PATENT DOCUMENTS

| | | | |
|---|---|---|---|
| 0122812 | 7/1985 | Japan | 110/250 |

*Primary Examiner*—Edward G. Favors

*Attorney, Agent, or Firm*—Oblon, Fisher, Spivak, McClelland, & Maier

[57] ABSTRACT

An operating method for a refuse processing furnace which processes refuse by melting with electric power, comprising steps of detecting a surface level of heaped refuse in the furnace and controlling amount of either or both of power input and refuse input into the furnace in response to the detected level of the heaped refuse in the furnace. The method assures stable processing with constant yield or outflow of molten refuse besides preventing the furnace and its equipments from being damaged by heat radiation from the molten surface.

8 Claims, 7 Drawing Figures

OPERATING METHOD FOR A REFUSE PROCESSING FURNACE

BACKGROUND OF THE INVENTION

1. Field of the Invention

The invention relates to an operating method for a refuse processing furnace in which refuse like incineration residue or sewer sludge is melted.

2. Prior Art

When collected urban garbage is incinerated in a burning furnace, there remains incineration residue, or ash, which may contain harmful heavy metal elements as chromium, zinc, lead, cadmium, mercury, etc. Sewer sludge is another harmful refuse that may contain such heavy metal elements. Therefore, the natural dumping of such residue or refuse is generally regulated or prohibited in some countries.

In order to make the refuse safe, many measures have been taken. It is buried into deep underground. In this case, however, the heavy metal elements may infiltrate into the environment soil and dissolve into the underground water.

It is then proposed that the refuse is processed by melting with a reflection furnace, an induction furnace or an electric arc furnace. These melting processes have advantages that the melted and solidified material has less volume compared to the unprocessed refuse and the harmful heavy metals will not come out of the solidified material. Among these processes, the electric arc furnace process is shown, for example, in the Japanese Published Unexamined Patent Application No. Sho 52-86976. There are still three variations in the electric arc furnace melting process. One is called an open arc process in which naked electrodes are kept apart from uncovered surface of molten refuse during the process and the electric discharge arc is generated between the electrodes and the molten refuse. Another is called a resistance heating process, in which electrodes are plunged into unmolten refuse floating over molten refuse, electric current between those electrodes goes through the unmolten refuse and the refuse is melted by the heat generated by the Joule effect or the resistance heat. The last one is called a submerged arc heating process in which the two preceding methods are combined.

An example of the submerged arc heating process is shown in the Japanese Published Examined Patent Application No. Sho 57-55476. In this method, the electrodes of the furnace are plunged into a heap of unmolten refuse floating over the molten refuse in the furnace. The discharge arc is generated between the electrodes and the molten refuse, while the resistance heat is also generated within the unmolten refuse. This heating method has an advantage that the heat radiation from the molten surface is much reduced because it is prevented by the unmolten refuse covering the molten surface. Therefore, the input electric power can be reduced and apparatuses on the top of the furnace are protected from high temperature. Another advantage of the heating method is that emergence of dust from the molten surface caused by strikes of the electric discharge arc is also reduced.

The assignee of the present invention has proposed another example of such submerged arc heating process in the Japanese Published Unexamined Patent Application No. Sho 52-143965. In the method, refuse or sludge is put on molten base metal material, e.g., molten iron, in the furnace. The refuse or sludge is then melted by the abovementioned submerge arc process with reducing atmosphere. The heavy metals in the refuse or sludge is transferred to and dissolved in the base molten metal and also in the molten slag (melted refuse or sludge) on the molten base metal.

In these operating methods for refuse furnaces, there still remains problems as follows. The input amount of electric power and the charging amount of refuse are not well controlled. The electric power is controlled by changing voltage with a tap operation. Since there is a large variety in metal content of the refuse, the electric resistance of the refuse varies as well, requiring frequent manual change of the tap. The refuse charging is, at most, controlled depending on the detected temperature at the top of the furnace. When the ventilativeness or heat transfer property of the unmolten refuse varies, the detected temperature does not indicate the heaped amount of unmolten refuse on the molten refuse. In any case, the problems are that the discharge flow of molten refuse out of the furnace cannot be regulated to be constant and tedious manual operations are required during the process.

SUMMARY OF THE INVENTION

An object of the present invention is to provide an atuomated operating method for a refuse processing furnace without tedious time after time operations.

Another object of the invention is to stabilize the conditions of the furnace, especially to make the discharge flow of the molten product constant.

Another object is to prolong the duration of the furnace by preventing it from being damaged by heat.

Another object is to manage a large area furnace with a plurality of refuse inlets.

Another object is to prevent the circumstance of the furnace from being contaminated by harmful fumes.

In order to achieve these and other objects, the operating method for a refuse processing furnace according to the present invention includes steps of:

(a) detecting a surface level of a heap of unmolten refuse in the furnace; and (b) controlling amount of either or both of power input and refuse input into the furnace in response to a level value of the heap of unmolten refuse in the furnace detected at the step (a).

The level detector for performing the step (a) can be realized by a weight lifting type or by a sonic wave type of level detector. In the weight lifting type, a weight is suspended by a wire and the lifting torque of a lifting motor is measured until it changes when the weight comes in contact with or depart from the heaped surface of the refuse. In the sonic wave type, a sonic wave is emitted from the top of the furnace, is reflected at the heaped surface and is caught again at the top to measure the traveling time which is proportionate to the distance between the top and the surface. Other level detectors may, of course, be used instead.

The input power can be varied stepwisely or linearly.

The operating method may further comprise a step of (c) detecting a temperature at a top portion of the furnace and the step (b) then may comprise a step of (d) controlling amount of either or both of power input and refuse input into the furnace, in response to the detected level of the heaped unmolten refuse and the detected temperature at the top of the furnace, so that the temperature at the top of the furnace remains below a predetermined value.

When the operating method is applied to a submerged arc furnace with a plurality of electrodes submerged into the heaped unmolten refuse, an impedance can be controlled to be constant when the input power is controlled to be constant in the step (b). Here, the impedance is defined as a voltage divided by an electric current between the electrodes of the furnace.

When the furnace is provided with a plurality of refuse inlets and a plurality of level meters each corresponding to each inlets, the step (a) may comprise a step of (e) detecting every surface level of heaps of unmolten refuse under the inlets with the level meters; and the step (b) comprises steps of (f) deriving a maximum value and a minimum value among values of surface level detected at the step (e);

(g) calculating a difference between the maximum value and the minimum value;

(h) determining an input port at which the minimum value of the surface level is detected when the difference is greater than a predetermined value; and (i) increasing amount of refuse input from the input port determined at the step (h).

The operating method is especially efficient in operating a submerged arc furnace for processing refuse of incineration residue of urban garbage.

BRIEF DESCRIPTION OF THE DRAWINGS

The foregoing and other objects and features of the present invention will become more apparent upon a consideration of the following description taken in connection with the accompanying drawings wherein.

DETAILED DESCRIPTION OF THE PREFERRED EMBODIMENTS

Figure 1:
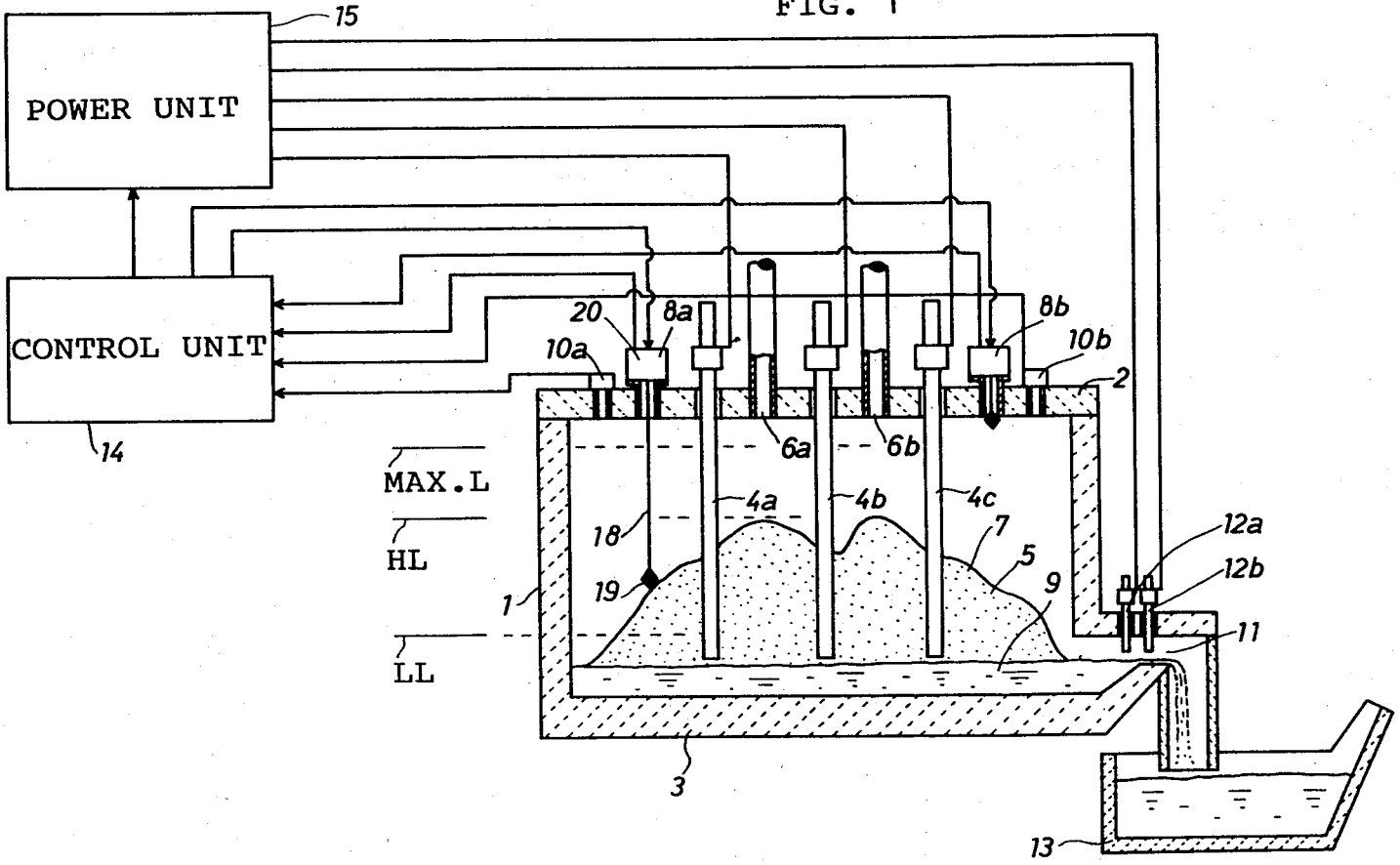
FIG. 1 is a sectional view of an electric arc furnace for processing refuse and corresponding block diagram of electric structure for its control.
Figure 2:
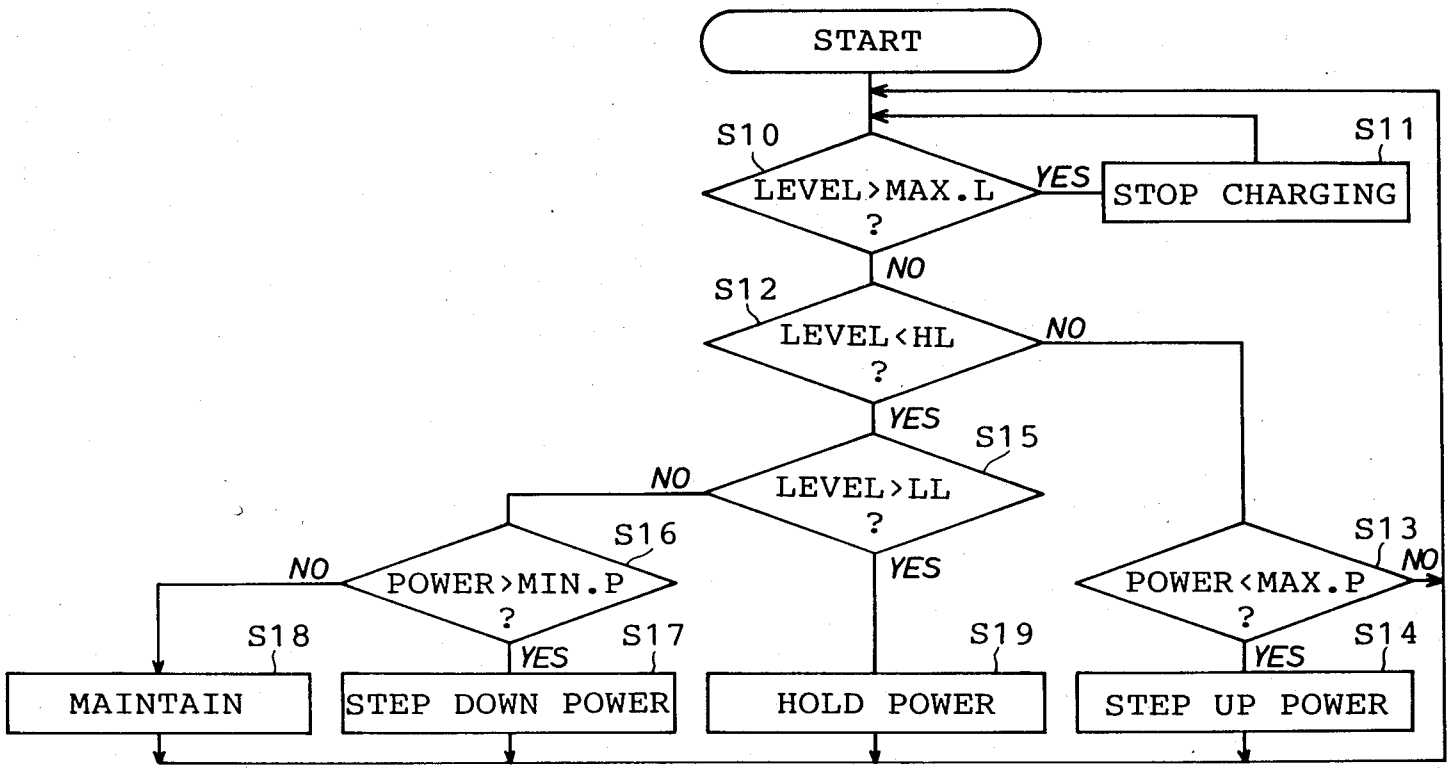
FIG. 2 is a flow chart of processing steps according to the first embodiment of the invention.

The first embodiment of the present invention is here explained with the drawings of FIG. 1 and FIG. 2. FIG. 1 is a sectional view of an electric arc furnace for processing refuse. At a roof 2 of a furnace 1, three main electrodes 4*a*, 4*b* and 4*c* are provided penetrating the roof 2 and reaching near a bottom 3 of the furnace 1. Refuse inlets 6*a* and 6*b*, level detectors 8*a* and 8*b*, and thermometers 10*a* and 10*b* are also provided on the roof 2.

Each of the level detectors 8*a* and 8*b* is constructed of a motor 20, a wire 18 and a weight 19. The weight 19 is wound up or down by the motor 20 and the winding torque is measured. When the weight 19 comes in contact with or depart from a heaped layer 7 of unmolten refuse 5 in the furnace 1, the winding torque changes largely, where the surface level of the heaped layer 7 is detected. The thermometers 10*a* and 10*b*, which includes thermocouples, are provided in order to prevent the apparatuses on the roof 2 including the weight 19 from being damaged by heat radiation from the surface of a pond of molten refuse 9. When the temperature at the roof is determined to exceed 800° C., the weight 19 is retrieved by winding up the wire 18.

Subsidiary electrodes 12*a* and 12*b* are provided at the top of discharge port 11 of the furnace 1 for preventing the molten refuse 9 from solidifying there. Therefore, continuous operation of the furnace can be performed because the flow of molten refuse 9 is discharged continuously to a slag ladle 13 during the process.

The signals from the level detectors 8*a* and 8*b* and the thermometers 10*a* and 10*b* are inputted into a control unit 14 which includes a microcomputer and other circuits. The control unit 14 controls the mottor 20 winding up or down the weight 19 and, through a power unit 15, controls the input power into the electrodes 4*a*, 4*b* and 4*c* in a stepwise manner.

The operating method of the furnace as the first embodiment of the invention is then explained with a flow chart of FIG. 2. First after start, it is determined at step S10 whether the current surface level of the heaped layer 7 is higher than a maximum allowable level MAX.L which is predetermined in the design of the furnace. Generally in the operating process, the average value of the outputs of the two level detectors 8*a* and 8*b* is used as the current level. But the higher value is used for the determination at step S10. When the current level is determined to be higher than MAX.L at step S10, the discharging of refuse 5 from the inlets 6*a* and 6*b* into the furnace 1 is stopped at step S11 until the level becomes lower than MAX.L. When the current level is determined to be not higher than MAX.L at step S10, it is then determined at step S12 whether to be lower than a high level HL which is predetermined for this operating method through prior experimental operations. When the current level is determined to be not lower than HL at step S12 and the current input electric power is determined to be less than a maximum allowable input power MAX.P for the furnace 1 at step S13, the input power is increased by one step of preset unit at step S14. This preset unit is determined according to the taps of the power unit 15. The power is increased stepwisely because the time lag from the power change to the melting of the refuse 5 can be minimized, improving the responsiveness of the process. Of course, linear or continuous alteration of the input power is available in this embodiment.

When the current level is determined to be lower than HL at step S12, it is then determined at step S15 whether to be higher than a low level LL which is also predetermined by prior experiments. When the current level is determined to be not higher than LL at step S15 and the input power is determined to be greater than a minimum allowable input power MIN.P at step S16, the input power is decreased by one step of the preset unit at step S17. The minimum input power MIN.P is a value below which the molten refuse 9 begins to solidify in the furnace 1. When the input power is determined to be not greater than MIN.P at step S16, which means the power is equal to the MIN.P because the power is changed stepwisely, the operating conditions including the amount of input power and the amount of the refuse charging are maintained at step S18.

When the current level is determined to be between HL and LL at steps S12 and S15, the input power is held as it is at step S19.

In this embodiment, the amount of input power and refuse charging is controlled depending on the detected surface level of the heaped layer 7 of the refuse 5 in the furnace 1. Therefore, the outflow of the molten refuse, or slag, 9 from the furnace 1 is kept substantially constant throughout the process and the operation of the furnace 1 is automated.

Figure 3A:
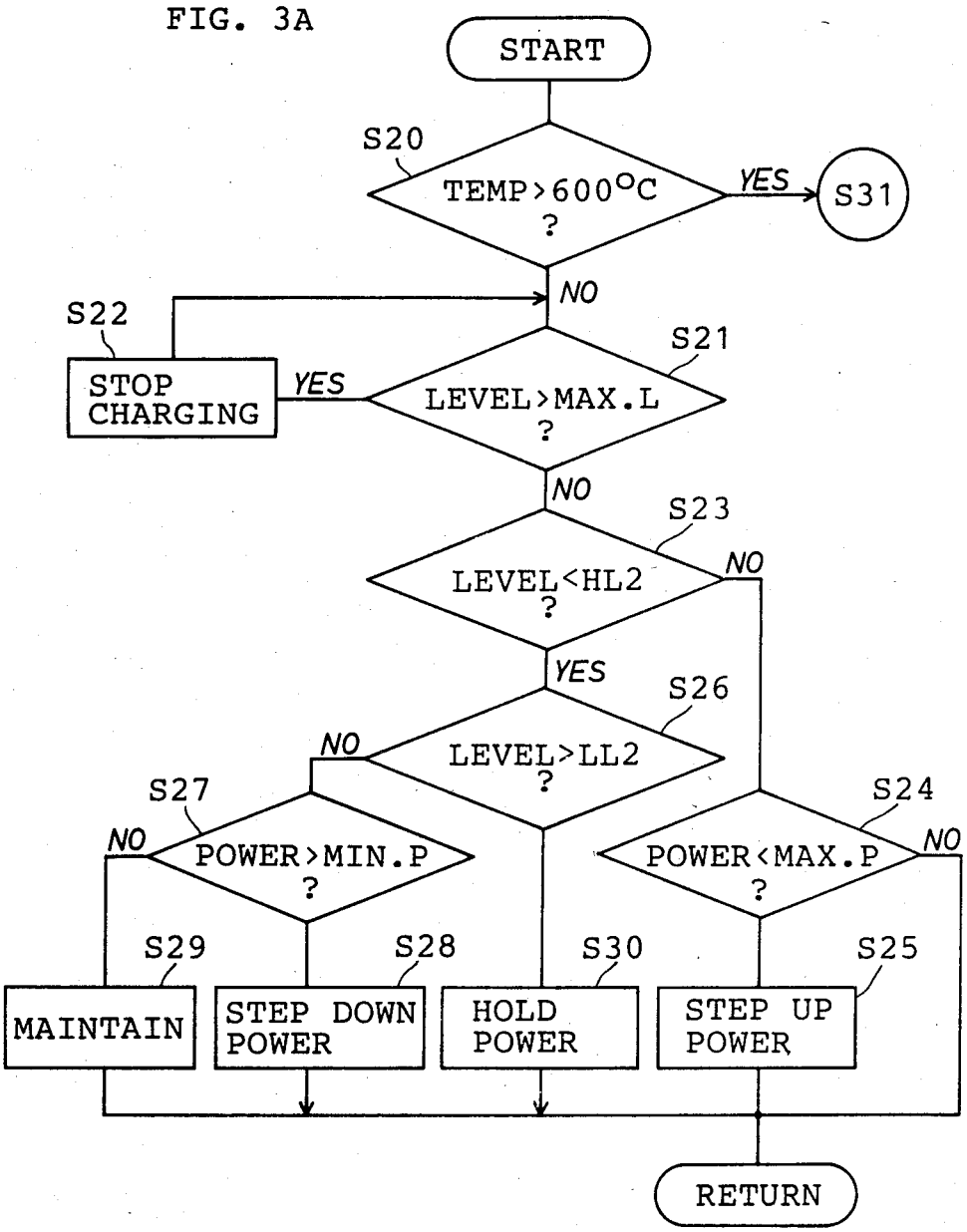
FIGS. 3A and 3B are flow charts integrally showing processing steps according to the second embodiment of the invention.
Figure 3B:
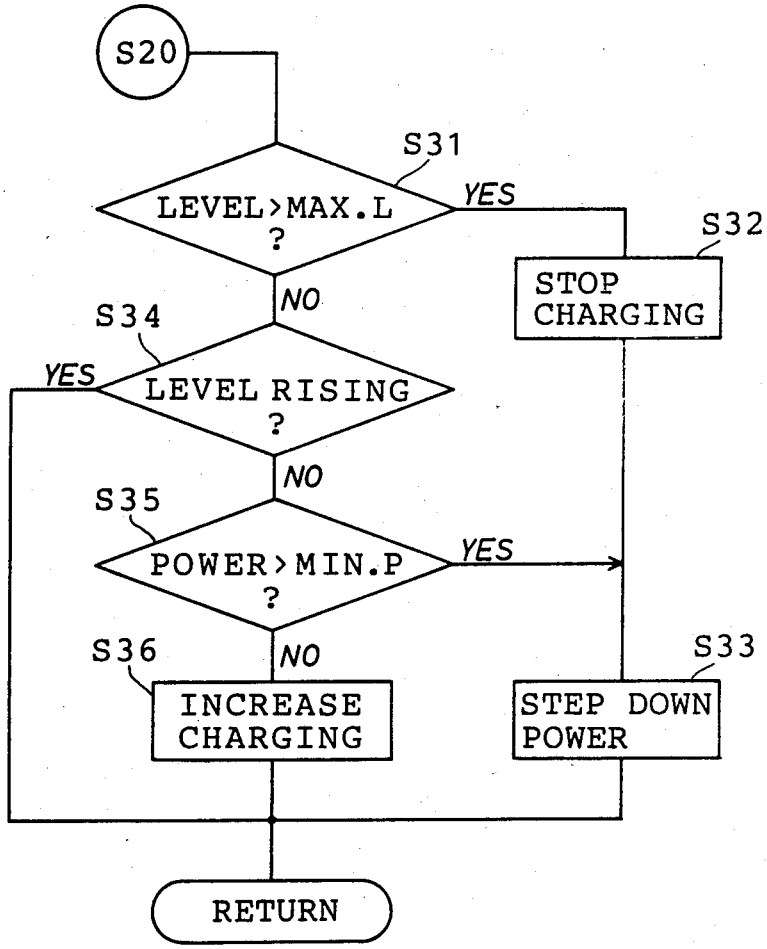

The second embodiment of the invention is then explained with flow charts of FIGS. 3A and 3B. As the operating method of this embodiment is for the same furnace as explained above in the first embodiment, only the processing steps are described here.

First after start, roof temperatures are detected by the thermometers 10*a* and 10*b* and it is determined whether the higher one is higher than 600° C. at step S20. When both of the temperatures are determined to be lower than 600° C. at step S20, it is then determined at step S21 whether the current surface level of the heaped layer 7 of refuse 5 is higher than the maximum allowable level MAX.L. When the current level is higher than MAX.L, the flow of the refuse 5 from the inlets 6*a* and 6*b* is stopped until the level becomes not higher than MAX.L. When the level is not higher than MAX.L, it is then determined at step S23 whether the level is lower than a high level HL2 which is determined for this operating method through prior experimental operations. When the level is determined to be not lower than HL2 and the input power is determined to be less than the maximum allowable input power MAX.P at step S24, the input power is increased by one step at step S25.

When the level is lower than HL2, it is then determined at step S26 whether the level is higher than a low level LL2 which is also predetermined for the operating method. When the level is determined to be still lower than LL2 at step S26 and the input power is determined to be greater than the minimum allowable input power MIN.P at step S27, the input power is decreased by one step at step S28. When the input power is determined to be not greater than MIN.P, i.e., the power is equal to MIN.P, at step S27, the operating conditions including the amount of input power and the amount of the refuse charging are maintained at step S29. When the current level is determined to be within a range between HL2 and LL2 at steps S23 and S26, the input power is held as it is at step S30.

When one of the temperatures is determined to exceed 600° C. at step S20, processings are executed from steps S31 to S36 to make the roof temperature lower than 600° C. First in these processings, the current level is determined whether to be higher than MAX.L at step S31 and, in the affirmative case, the charging of the refuse 5 is stopped at step S32 and the input power is decreased by one step at step S33. This case arises when the heaped refuse 7 is so coarse or ventilative that the heat radiation from the molten surface passes through the high heap of refuse 7 losing little strength.

When the level is determined to be not higher than MAX.L at step S31, it is then determined at step S34 whether the level is rising. When the level is determined to be rising, no special processing is executed then because the roof temperature will naturally decrease in the meantime. This enables keeping of high power processing of the refuse and increases the efficiency of the process. When the level is determined not to be rising at step S34, i.e., the melting rate of the refuse 5 is faster than the charging rate, it is then determined at step S35 whether the input power is greater than MIN.P. When the input power is determined to be greater than that, it is decreased by one step at step S33. When it is not greater than MIN.P, the influx of the refuse 5 is increased at step S36 because the input power cannot be decreased any more. The roof temperature is thus kept below 600° C. and the furnace 1 and the apparatuses such as the level detectors 8*a* and 8*b* are protected from being damaged by the heat.

In the above explanation, the roof temperature can be replaced by a temperature of outflowing gas from the furnace 1.

Another operating method for a refuse processing furnace which differs a little from that of the first and the second embodiments is then explained as the third embodiment of the invention. The furnace of the third embodiment, whose structure is also referred to FIG. 1, differs from that of the first and the second embodiments in that an elevating mechanism (not shown) is provided for each of the electrodes 4*a*, 4*b* and 4*c* to vertically move the each electrode responsive to command signals from the control unit 14.

The processings of the operating method of the third embodiment is substantially consistent with those of the first and the second embodiments. Therefore the flow charts of FIG. 2 and FIGS. 3A and 3B are also referred for this third embodiment. The difference of this embodiment from the preceding two is then explained.

The input electric power is changed stepwisely at steps S14, S17, S25, S28 and S33 in the preceding embodiments. This power change is done by changing taps of the power unit 15, actually changing the voltage applied to the electrodes. Increasing the power input by one step is changing to the higher tap. In this third embodiment, however, the input power is changed continuously and, when the input power is once determined, it is controlled to keep the impedance between the electrodes 4*a*, 4*b* and 4*c* constant. Here the impedance is defined by the voltage between the electrodes 4*a*, 4*b* and 4*c* divided by the electric current between the electrodes 4*a*, 4*b* and 4*c*.

The impedance between the electrodes 4*a*, 4*b* and 4*c* can be controlled by adjusting the height of the tips of the electrodes 4*a*, 4*b* and 4*c* from the surface of the molten pond 9. When the height is small, more current flows mainly through the molten refuse 9 with discharge arcs between the electrodes 4*a*, 4*b* and 4*c* and the molten refuse 9, making the impedance low. When the height is large, less current flows mainly through the heaped layer of unmolten refuse 7, making the impedance high.

This embodiment eliminates the tapping operation which has been a primary cause of process failure or furnace failure because the tap contact points are worn out rapidly and are damaged by discharge arc therebetween. Another advantage is that the continuous power change control can render elaborate control of molten refuse outflow from the furnace 1. This embodiment is especially effective when the metal content of the input refuse varies so largely that the electric resistance between electrodes through the refuse also varies largely. Actual refuse or incineration residue may contain iron content of from 0 to 45%. The resistance variation is compensated by this control method.

An example of some figures of this third embodiment is then shown. The furnace as shown in FIG. 1 has an inner diameter of 900 mm with a 3-phase transformer having capacity of 360 kVA. Various refuses whose iron contents are shown in Table 1 are processed by the furnace with processing rates of 100 to 150 kilogram refuse per hour. The applied voltage is controlled at 100 V or at 125 V and the impedance between the electrodes is controlled as described in the preceding explanation. The total input energy is from 120 to 150 kWh. The power factor and the controllability of each processed refuse is also shown in Table 1. As seen from Table 1, the controllability is good, which means that the tap changing is eliminated and the discharge arc is stabilized throughout the process, by this impedance control method. The input energy per unit of processed refuse is 700 to 800 kWh/ton by this method, while that by the conventional method is 570 to 660 kWh/ton.

TABLE 1

| | Process Result by Impedance Control | | |
|---|---|---|---|
| No. | iron content (%) | power factor | controllability |
| 1 | 0 | 0.95 | good |
| 2 | 20 | 0.85 | good |
| 3 | 40 | 0.80 | good |

Figure 4:
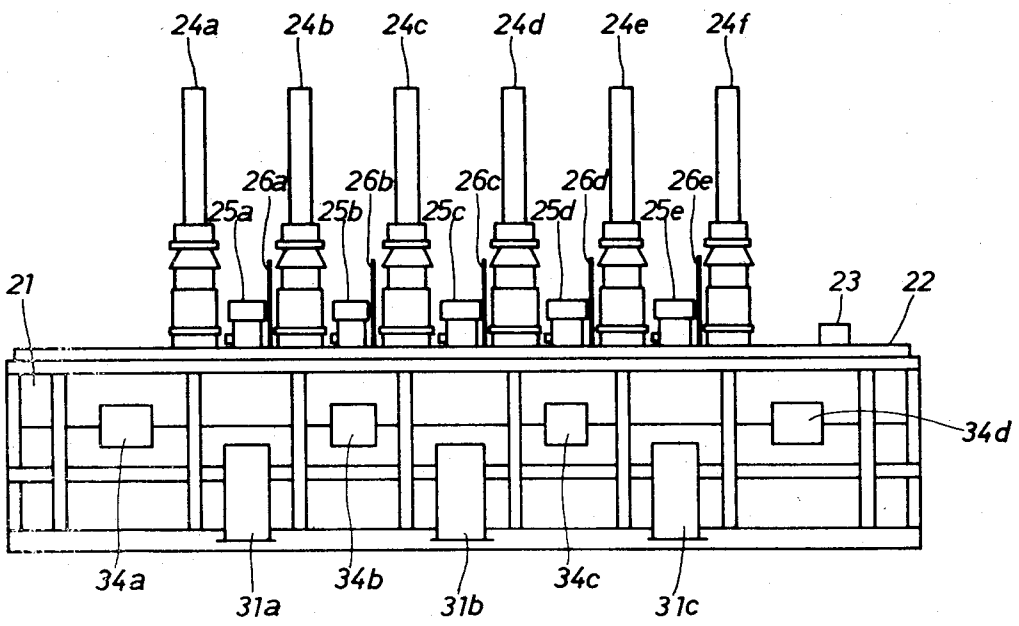
FIG. 4 is a side view of another electric arc furnace for processing refuse.
Figure 5:
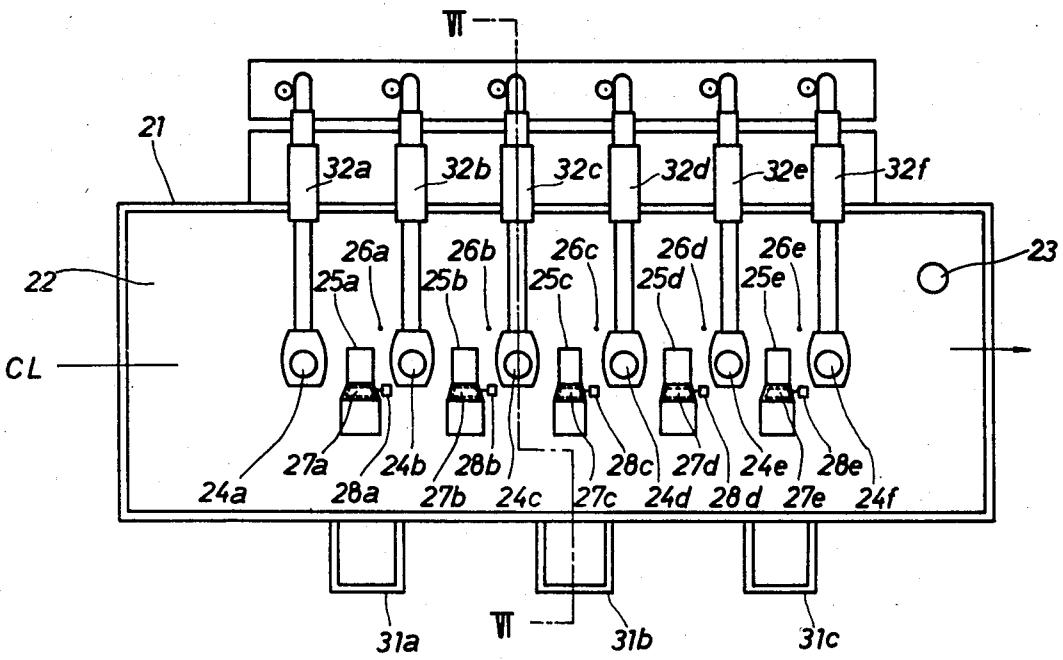
FIG. 5 is a plan view of the furnace of FIG. 4.
Figure 6:
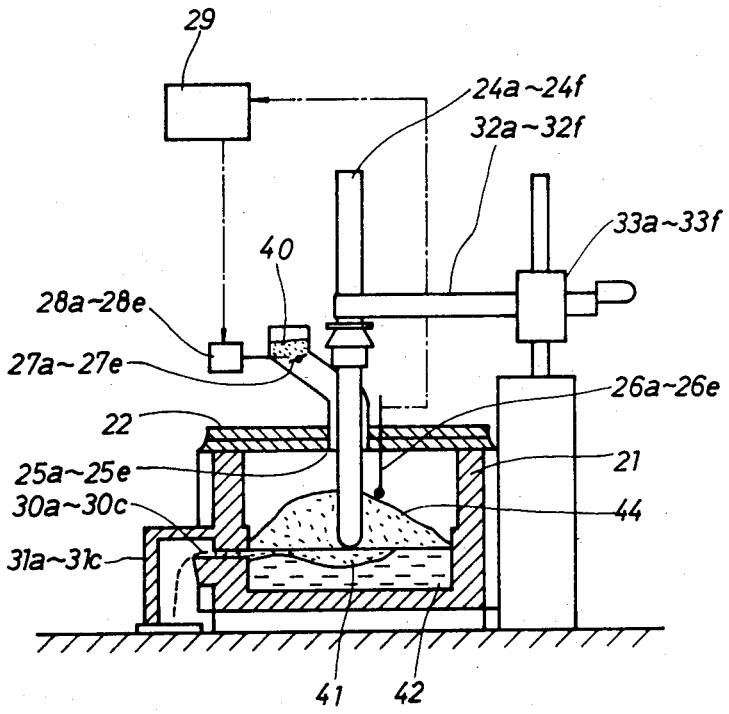
FIG. 6 is a sectional view of the furnace taken along line VI—VI of FIG. 5.

The fourth embodiment of the invention is an operating methiod preferable for a long or large area furnace with a plurality of refuse inlets. An example of the furnace for which this embodiment is applied is shown in FIGS. 4, 5 and 6. FIG. 4 is a side view of the furnace, FIG. 5 is a plan view and FIG. 6 is an explanatory figure with partly cross-sectional view taken along line VI—VI.

This furnace 21 is made long to be installed six graphite electrodes 24*a*, 24*b*, 24*c*, 24*d*, 24*e* and 24*f* regularly along line CL on its roof 22. Each of the electrodes 24*a–f* is held by each of six holder arms 32*a*, 32*b*, 32*c*, 32*d*, 32*e* and 32*f*, which is moved up or down by each of six elevators 33*a*, 33*b*, 33*c*, 33*d*, 33*e* and 33*f*.

Five refuse inlets 25*a*, 25*b*, 25*c*, 25*d* and 25*e* and five level detectors 26*a*, 26*b*, 26*c*, 26*d* and 26*e*, each corresponding to each of the refuse inlets 25*a–e*, are installed between the six electrodes 24*a–f* on the roof 22. A gas outlet 23 is also installed at an end of the roof 22. Each of five damper valves 27*a*, 27*b*, 27*c*, 27*d* and 27*e* which is rotated by each of five motors 28*a*, 28*b*, 28*c*, 28*d* and 28*e* is provided at each refuse of the inlets 25*a–e*.

A control device 29 in FIG. 6 is connected to the level detectors 26*a–e* and the motors 28*a–e*. Three discharge ports 30*a*, 30*b* and 30*c* are regularly provided at a side of the furnace 21 with covers 31*a*, 31*b* and 31*c*. Four maintenance doors 34*a*, 34*b*, 34*c* and 34*d* are also provided on the side wall of the furnace 21.

The operating method of the fourth embodiment is then explained. First, molten pond of base metal, iron in this case, 42 is prepared by an ordinary electric arc melting process and starting material is put on the surface of the molten metal 42. The starting material is similar in its component with the refuse to be processed but has lower melting point than that.

When the starting material is melt down and heated at about 1450° C. to 1550° C., refuse 40 is started to be dropped down from the inlets 25*a–e* with the damper valves 27*a–e* opened by the motors 28*a–e*. The dropped refuse 40 is then melted by the heat from the molten base metal 42 and by electric discharge arc between the electrodes 24*a–f* and makes a molten layer 41 on the molten base metal 42. The molten refuse 41 continuously flows out of the discharge ports 30*a–c*.

Since, at first, the dropping rate of the refuse 40 is greater than the melting rate, the dropped refuse makes a heap 44 on the molten layer 41. As there is five refuse inlets 25*a–e* on the roof 22, five heaps 44 are created on the molten layer 41 and it is natural that there are differences in the levels of the heaps 44. Each level of the heaps 44 is measured by the corresponding level detector 26*a*, 26*b*, 26*c*, 26*d* or 26*e* and the measured value is transmitted to the control device 29.

The level of the heaps 44 is controlled by the control device 29 to attain maximum efficiency of the process. Substantial processing steps of this embodiment for controlling the refuse level is consistent with that of the first embodiment. In this embodiment, besides that, the levels of the heaps 44 are controlled to be nearly equalized.

When the maximum difference among the five level values of the heap 44 exceeds a reference value, the control device 29 controls one of the motors 28*a–e* of the inlets 25*a–e* which corresponds to the minimum level of the heap 44 to increase the opening of the damper valve 27*a–e* in order to increase the drop rate. The reference value is predetermined by preparatory experiments according to the object of the process and the physical characteristic of the processed refuse 40. For constant outflow of the molten refuse from the discharge ports 30*a–c*, small reference value is desired. On the other hand, the responsiveness of the actual dropping rate of refuse should be considered in determining the reference value because too small reference value may cause uncontrollable hunting.

According to this operating method, the levels of the unmolten refuse 44 in the furnace 21 can be nearly equalized. Therefore, the electric arc is stabilized and the constant outflow of the molten refuse is assured even if there is a variety in physical properties, e.g., melting temperature or density, among the refuse charged from five inlets 25*a–e*. Further, since heat radiation from the molten surface to the roof 22 of the furnace 21 is also equalized throughout the area, serious heat damage of the furnace 21 and the roof equipments is prevented.

An example of concrete figures of operating conditions according to the fourth embodiment is then shown. The plan area of the furnace 21 is 3.3 squaremeters. The refuse 40 is incineration residue containing 10 weight% water. The maximum allowable level MAX.L for this furnace 21 is 45 centimeter, the high level HL is set at 35 centimeter and the low level LL is set at 30 centimeters. The measured levels of the heaps of unmolten refuse 44 according to the above conditions (of the present invention) are shown in Table 2 with the lapse of processing time. Those results according to conventional (prior art) method are also shown in Table 2. The effect of the control method of this invention is clear in the level differences.

TABLE 2

| | Each level and the maximum difference | | | | | |
|---|---|---|---|---|---|---|
| | Level Value at Detector | | | | | Max. |
| Time (minute) | 26a | 26b | 26c | 26d | 26e | Difference (centimeter) |
| | (centimeter) | | | | | |
| | present invention | | | | | |
| 10 | 30 | 33 | 30 | 33 | 32 | 3 |
| 20 | 34 | 32 | 33 | 32 | 31 | 3 |
| 30 | 33 | 34 | 33 | 32 | 32 | 2 |
| | prior art | | | | | |
| 20 | 30 | 27 | 25 | 18 | 37 | 19 |

TABLE 2-continued

| Time (minute) | Each level and the maximum difference: Level Value at Detector 26a (centimeter) | 26b | 26c | 26d | 26e | Max. Difference (centimeter) |
|---|---|---|---|---|---|---|
| 30 | 30 | 20 | 28 | 40 | 30 | 20 |

What is claimed is:

1. An operating method for a refuse processing furnace which processes refuse by melting with electric power, comprising steps of:

(a) detecting a surface level of a heap of unmolten refuse in the furnace and (b) controlling amount of both power input and refuse input into the furnace in response to a level value of the heap of unmolten refuse in the furnace detected at the step (a).

2. An operating method for a refuse processing furnace according to claim 1, wherein the method further comprises a step of (c) detecting a temperature at a top portion of the furnace and the step (b) comprises a step of (d) controlling amount of both power input and refuse input into the furnace, in response to the detected level of the heaped unmolten refuse and the detected temperature at the top of the furnace, so that the temperature at the top of the furnace remains below a predetermined value.

3. An operating method for a refuse processing furnace according to claim 1, wherein the furnace is a submerged arc furnace with a plurality of electrodes submerged into the heaped unmolten refuse and an impedance is controlled to be constant when the input power is controlled to be constant in the step (b), the impedance being defined as a voltage divided by an electric current between the electrodes of the furnace.

4. An operating method for a refuse processing furnace according to claim 1, wherein the furnace is provided with a plurality of refuse inlets and a plurality of level detectors each corresponding to each of said inlets, the step (a) comprises a step of (e) detecting every surface level of heaps of unmolten refuse under the inlets with the level detectors, and the step (b) comprises steps of (f) deriving a maximum value and a minimum value among values of surface level detected at the step (e), (g) calculating a difference between the maximum value and the minimum value, (h) determining an input port at which the minimum value of the surface level is detected when the difference is greater than a predetermined value and (i) increasing amount of refuse input from the input port determined at the step (h).

5. An operating method for a refuse processing furnace according to claim 1, wherein the furnace is a submerged arc furnace for processing refuse of incineration residue of urban garbage.

6. An operating method for a refuse processing furnace according to claim 1, wherein amount of power input is increased when the level value is greater than a predetermined high value and amount of power input is decreased when the level value is less than a predetermined low value in the step (b).

7. An operating method for a refuse processing furnace according to claim 2, wherein, in the step (b), amount of power input is increased when the temperature at the top of the furnace is lower than a predetermined value and the level value value is greater than a predetermined high value, amount of power input is decreased when the temperature at the top of the furnace is lower than the predetermined value and the level value is less than a predetermined low value, amount of power input is decreased and refuse input is stopped when the temperature at the top of the furnace is higher than the predetermined value and the level value is greater than a preset maximum value, and amount of refuse input is increased when the temperature at the top of the furnace is higher than the predetermined value and the level value is not determined to be increasing in the furnace.

8. An operating method for a refuse processing furnace according to claim 3, wherein the impedance is controlled by controlling every distance between a tip of every electrode and a surface of molten refuse in the furnace.

* * * * *